United States Patent [19]

Yasuda et al.

[11] Patent Number: 4,983,263

[45] Date of Patent: Jan. 8, 1991

[54] ZINCATE TYPE ZINC ALLOY ELECTROPLATING BATH

[75] Inventors: Yoshizumi Yasuda; Nobuaki Wada; Yukio Suzuki; Haruhisa Watai, all of Kariya, Japan

[73] Assignee: Yuken Kogyo Kabushiki Kaisha, Kariya, Japan

[21] Appl. No.: 437,836

[22] Filed: Nov. 17, 1989

[30] Foreign Application Priority Data

Nov. 21, 1988 [JP] Japan ..... 63-294161

[51] Int. Cl.[5] ..... C25D 3/56

[52] U.S. Cl. ..... 204/44.2

[58] Field of Search ..... 204/44.2

[56] References Cited

U.S. PATENT DOCUMENTS 4,861,442 8/1989 Nishihama et al. ..... 204/44.2

4,877,496 10/1989 Yanagawa et al. ..... 204/44.2

FOREIGN PATENT DOCUMENTS 62-238387 10/1987 Japan .

2155493 9/1985 United Kingdom .

*Primary Examiner*—G. L. Kaplan

*Attorney, Agent, or Firm*—Dennison, Meserole, Pollack & Scheiner

[57] ABSTRACT

A zincate type zinc alloy electroplating bath which comprises a Zn compound, an alkali hydroxide, a salt of Fe(II, III) or Ni(II), a chelating agent for dissolving said salt of Fe(II, III) or Ni(II) and brightening agents. The chelating agent is selected from the group consisting of a commercially available chelating agent and a reaction product of a mixture of one or more kinds of aliphatic amine with epihalohydrin. The brightening agents contain alkylated polyalkylene polyamine in which some of the basic nitrogen atoms of polyalkylene polyamine are alkylated by alkyl groups of $C_1$ to $C_3$, and one or more compounds selected from the group consisting of reaction products of imidazole or its derivative with epihalohydrin and reaction products of imidazole or its derivative with epihalohydrin in the presence of aliphatic amine.

15 Claims, No Drawings

ZINCATE TYPE ZINC ALLOY ELECTROPLATING BATH

BACKGROUND OF THE INVENTION

1. Field of the Invention

The present invention relates to a zincate type zinc alloy electroplating bath prepared by dissolving a salt of Fe(II, III) or Ni(II) in the presence of a chelating agent and by adding brightening agents.

2. Description of the Prior Art

It is well known that combined deposition of iron (Fe) or nickel (Ni) in zinc plated coatings results in improved corrosion resistance thereof. Various types of zinc alloy electroplating baths have been proposed heretofore to permit combined deposition of Fe or Ni.

In various zinc alloy electroplating baths which have been reported, a typical electroplating bath which permits deposition of an alloy of Zn-Fe or Zn-Ni is a zincate type zinc alloy electroplating bath which contains a salt of Fe or Ni in the presence of a chelating agent. Such a zincate type Zn-Fe alloy electroplating bath is described in Technical Reports published by Kyoto Prefectural Small Business General Guidance Division; Volume 7 (1979), pages 20 to 26, Volume 8 (1980), pages 43 to 45 and Volume 9 (1981), pages 32 to 37, and in Practical Surface Technique, Volume 29 (1982), No. 8, pages 383 to 387, published by The Surface Finishing Society of Japan. Also, a zincate type Zn-Ni alloy electroplating bath is described in Digest of the 70th Scientific Lecture Meeting (1984), pages 28 to 29, published by The Surface Finishing Society of Japan.

In many cases, zinc electroplated coatings are subjected to chromate treatment for the purpose of improving corrosion resistance. However, higher deposition ratio of Fe or Ni prevents application of a good chromate coating. On the contrary, lower deposition ratio prevents satisfactory improvement of corrosion resistance. Therefore, the deposition ratio of Fe or Ni must be relatively closely controlled. It has been reported from results of researches that the desirable range of the deposition ratio is 0.1 to 5% for Fe and 2 to 20% for Ni.

In regard to appearance, the plated surface is desired to have excellent brightness, because the quality of the plated surface obtained by post-treatment such as chromate treatment largely depends upon the brightness of the plated surface before such post-treatment.

In electroplating processes, it is technically difficult to maintain a uniform current density over the whole surface of an article to be plated. For example, when articles having projected portions and recessed portions are plated, the current density on the projected portions becomes higher than that on the recessed portions, and it is difficult to obtain a substantially equal current density on these two portions. Therefore, the important condition required for a practical zinc alloy electroplating bath is to assure provision of a substantially constant alloy composition ratio in a wide range of current density as well as provision of coatings having excellent brightness in a wide range of current density.

Practical usability of the conventional Zn-Fe and Zn-Ni alloy electroplating baths as described above has been examined, with the result that, in these alloy electroplating baths, the range of the current density which allows provision of bright coatings is narrow, and the deposition ratio of Fe or Ni to Zn largely depends upon the level of the current density.

In order to avoid the disadvantages of the conventional alloy electroplating baths, the present inventors have developed a zinc alloy electroplating bath as follows. The bath is a zincate type zinc alloy electroplating bath containing a Zn compound, an alkali hydroxide, a salt of Fe(II, III) or Ni(II), a chelating agent for dissolving the salt of Fe(II, III) or Ni(II) and a brightening agent. The brightening agent used here is an alkylated polyalkylene polyamine in which basic nitrogen atoms of polyalkylene polyamine are partially alkylated by alkyl groups of $C_1$ to $C_3$. This zinc alloy electroplating bath is disclosed in Japanese Laid-Open Patent Publication No. 62-238387. It has been found that, from such a zinc alloy electroplating bath, bright coatings may be obtained in a relatively wide range of current density, and variations in deposition ratio of Fe or Ni in accordance with the level of the current density is small. In the zinc alloy electroplating bath, the range of the current density assuring provision of satisfactorily plated coatings is 0.2 to 15 A/dm$^2$. The present invention has been worked out to further improve the electroplating bath as disclosed in the above Japanese Laid-Open Patent Publication No. 62-238387.

SUMMARY OF THE INVENTION

It is, accordingly, an object of the present invention to provide a zincate type zinc alloy electroplating bath in which electroplated coatings with good brightness may be obtained in a wide range of current density.

It is another object of the present invention to provide such an electroplating bath in which variations in deposition ratio of Fe or Ni due to change in the current density is very small.

It is a further object of the present invention to provide such an electroplating bath which permits electroplating at a high current density.

It is a still further object of the present invention which may shorten electroplating times.

According to the present invention, there is provided a zincate type zinc alloy electroplating bath which comprises a Zn compound, an alkali hydroxide, a salt of Fe(II, III) or Ni(II), a chelating agent for dissolving the salt of Fe(II, III) or Ni(II) and brightening agents. The chelating agent is selected from the group consisting of a commercially available chelating agent and a reaction product of a mixture of one or more kinds of aliphatic amine with epihalohydrin. The brightening agents contain alkylated polyalkylene polyamine in which basic nitrogen atoms of polyalkylene polyamine are partly alkylated by alkyl groups of $C_1$ to $C_3$, and one or more compounds selected from the group consisting of reaction products of imidazole or its derivative with epihalohydrin and reaction products of imidazole or its derivative with epihalohydrin in the presence of aliphatic amine.

In the zincate type zinc alloy electroplating bath of the present invention, the brightening agents contain (1) alkylated polyalkylene polyamine in which basic nitrogen atoms of polyalkylene polyamine are partly alkylated by alkyl groups of $C_1$ to $C_3$ and (2) one or more compounds selected from the group consisting of reaction products of imidazole or its derivative with epihalohydrin and reaction products of imidazole or its derivative with epihalohydrin in the presence of aliphatic amine. Thus, the following effects may be obtained.

Zinc alloy electroplating coatings having good brightness may be obtained in a wide range of current density from 0.1 to 20 A/dm$^2$. Variations in the deposition ratio of Fe or Ni due to change in the current density is very small, assuring provision of Zn alloy electroplating coatings having a stable composition within a wide range of current density.

Furthermore, the allowable current density range has been from 0.2 to 15 $A/dm^2$ in the conventional electroplating bath, but it is widened from 0.1 to 20 $A/dm^2$ in the electroplating bath of the present invention. As is apparent, the allowable current density range is widened especially in the high current density portion, which permits electroplating at a high current density. The current density employed is inversely proportional to the plating time required to obtain a plated coating having a desired thickness. Therefore, the electroplating bath of the present invention may shorten the time required for electroplating.

The basic bath composition used in the present invention is as follows.

Basic bath composition

ZnO: 4 to 40 g/l
Sodium hydroxide (NaOH): 30 to 200 g/l
Fe or Ni: 0.02 to 10 g/l
Chelating agent: 0.5 to 300 g/l The above described excellent effects obtainable by using two kinds of brightening agents are considered to be particularly eminent in the basic bath having the above composition.

DETAILED DESCRIPTION OF THE INVENTION

Now, the present invention will be more fully described with reference to preferred embodiments.

The electroplating bath of the present invention includes as a basic bath a zincate bath containing a Zn compound, an alkali hydroxide, a salt of Fe(II, III) or Ni(II) and a chelating agent for dissolving the salt of Fe(II, III) or Ni(II), with two kinds of brightening agents added.

In the above basic bath, the Zn compound may be typically ZnO, and alkali hydroxide may be NaOH, KOH or the like. The content of the Zn compound is 4 to 40 g/l calculated as ZnO, and the content of the alkali hydroxide is 30 to 200 g/l calculated as NaOH. The salt of Fe may be $Fe_2(SO_4)_3.7H_2O$, $FeSO_4.7H_2O$, $Fe(OH)_3$, $FeCl_3.6H_2O$, $FeCl_2.4H_2O$ or the like. The salt of Ni may be $NiSO_4.6H_2O$, $NiCl_2.6H_2O$, $Ni(OH)_2$ or the like. The content of Fe or Ni is 0.02 to 10 g/l calculated as metal. Examples of the chelating agent suitable for dissolving the salt of Fe include hydroxycarboxylates such as citrate, tartrate, and gluconate; amino alcohols such as monoethanolamine, diethanolamine and triethanolamine; polyamines such as ethylenediamine (EDA), diethylenetriamine and triethylenetetramine; aminocarboxylates such as ethylenediaminetetraacetate and nitrilotriacetate; polyhydric alcohols such as soRbitol and pentaerythritol; or thiourea; or mixtures thereof. Examples of the chelating agent suitable for dissolving the salt of Ni include sodium tartate, sodium gluconate, NaCN, triethanolamine, ethylenediamine, pentaethylene hexamine, N,N,N',N'-tetrakis-(2-hydroxypropyl)ethylenediamine, EDTA 2Na, N-hydroxyethyl ethylenediamine (HEEDA), diethylenetriamine; or a reaction product of a mixture of one or more kinds of aliphatic amine with epihalohydrin (hereinafter referred to as chelating agent A); or mixtures thereof. Triethanolamine is preferable for Fe, and diethylenetriamine (used singly as a chelating agent) and a reaction product of a mixture of one or more kinds of aliphatic amine with epihalohydrin (used as a synthetic chelating agent) are preferable for Ni. The content of the chelating agent is 0.5 to 300 g/l.

In order to prepare the above synthetic chelating agent, the following aliphatic amine and epihalohydrin may be used. Namely, examples of aliphatic amine include polyamines such as ethylenediamine, diethylenetriamine, N-hydroxyethylethylenediamine (HEEDA), pentaethylenehexamine, polyethyleneimine (having a molecular weight of 300 to 5,000); amino alcohols such as monoethanolamine, diethanolamine and triethanolamine; and mixtures thereof. Examples of epihalohydrin include epichlorohydrin and epibromohydrin. The following reaction products are preferable for the synthetic chelating agent: a reaction product of diethylenetriamine with epichlorohydrin, a reaction product of a mixture of diethylenetriamine and monoethanolamine with epichlorohydrin, and a reaction product of a mixture of diethylenetriamine and HEEDA with epichlorohydrin.

The following two kinds of brightening agents were used:

(a) alkylated polyalkylene polyamine in which basic nitrogen atoms of polyalkylene polyamine are partly alkylated by an alkylating agent having alkyl groups of $C_1$ to $C_3$ (hereinafter referred to as brightening agent 1); and (b) one or more compounds selected from the group consisting of reaction products of imidazole or its derivative with epihalohydrin, and reaction products of imidazole or its derivative with epihalohydrin in the presence of aliphatic amine (hereinafter referred to as brightening agent 2).

The amount to be added is 0.1 to 50 g/l (preferably 0.5 to 10 g/l) for both of brightening agents 1 and 2.

Polyalkylene polyamine may have a molecular weight of 300 to 5,000, and may be polyethyleneimine, polypropyleneimine and polybutyleneimine. Examples of the alkylating agent may be compounds of $C_1$ to $C_3$, such as $CH_3Cl$, $CH_3Br$, $CH_3I$, $C_2H_5Br$, $C_2H_5I$, $(CH_3)_2SO_4$, $(C_2H_5)_2SO_4$, $C_3H_7I$, $C_3H_7Cl$, and $C_3H_7Br$.

Examples of the derivative of imidazole include 1-methylimidazole, 1-ethylimidazole, 2-methylimidazole, 1,2-dimethylimidazole, 1-ethyl-2-methylimidazole, 1-vinylimidazole, 2-methyl-1-vinylimidazole, 1-(2'-hydroxyethyl)imidazole, and 1-(2'-hydroxyethyl)2-methylimidazole. Examples of the epihalohydrin include epichlorohydrin and epibromohydrin. Examples of the aliphatic amine include methylamine, dimethylamine, trimethylamine, ethylamine, diethylamine, triethylamine, propylamine, dipropylamine, tripropylamine, and ethyleneamines such as ethylenediamine and dietylenetriamine. Triethylamine and dimethylamine are preferable.

The brightening agent 1 is considered to serve to widen the allowable current density range in the lower current density portion as well as to stabilize the deposition ratio of Fe or Ni to Zn. The brightening agent 2 is considered to serve to widen the allowable current density range in the upper current density portion, preventing abnormal deposition such as burnt deposits to assure good electroplated coatings, as well as to stabilize the deposition ratio of Fe or Ni.

In the electroplating bath of the present invention, one or more brightening auxiliaries may be used, if required, in addition to the above two kinds of brightening agents in order to further improve brightness. Examples of such brightening auxiliaries include water soluble high polymers such as polyvinyl alcohol (PVA) and gelatin; sulfur compounds such as thiourea; and aromatic aldehydes such as anisaldehyde, heliotropin and vanillin; and mixtures thereof. The amount of the brightening auxiliares to be added is 0.01 to 30 g/l.

From the Zn-Fe or Zn-Ni alloy electroplating bath of the present invention, bright coatings can be obtained over the wide range of current density, even if concentrations of the constituents may change. Furthermore, variations in deposition ratio of Fe or Ni due to change of the current density is small.

Now, the examples of the present invention will be described.

Composition of Brightening Agent 1

Three kinds of polyethyleneimines having different molecular weights were dissolved in 100 g of water, and the solution was cooled and stirred, with dimethyl sulfate being added to the solution for 30 minutes. The solution was further kept stirred and heated to 80° C., and was maintained in this condition for 2 hours. Stirring was then stopped and the solution was cooled to obtain reaction products I to V. The reaction products I to V were obtained in the form of aqueous solution, and their concentration was 30 to 40%.

The molecular weights and added amounts of the polyethyleneimines and the added amount of dimethyl sulfate used to obtain the above reaction products are shown in Table 1.

TABLE 1

| Reaction Product No. | Polyethyleneimine Average Molecular Weight | Polyethyleneimine Added Amount (g) | Dimethyl Sulfate Added Amount (g) |
|---|---|---|---|
| I | 600 | 20 | 88 |
| II | 1400 | 70 | 30 |
| III | 1400 | 40 | 58 |
| IV | 1400 | 20 | 88 |
| V | 3000 | 40 | 58 |

Composition of Brightening Agent 2

Imidazole or derivative thereof and aliphatic amine were dissolved in 100 g of water, and the solution was cooled and stirred, with epichlorohydrin being added to the solution for 30 minutes. The solution was further kept stirred and heated to 95° C., and was maintained in this condition for 2 hours. Stirring was then stopped and the solution was cooled to obtain reaction products VI to IX. The reaction products VI to IX were obtained in the form of aqueous solution, and their concentration was 30 to 43%.

The kinds and added amount of imidazole or its derivative and aliphtic amine and the added amount of epichlorohydrin are shown in Table 2.

TABLE 2

| Reaction Product No. | Imidasole or Its Derivative Kind | Imidasole or Its Derivative Added Amount (g) | Aliphatic Amine Kind | Aliphatic Amine Added Amount (g) | Epichlorohydrin Added Amount (g) |
|---|---|---|---|---|---|
| VI | Imidazole | 20 | — | — | 27 |
| VII | 2-Methyl Imidazole | 5 | Dimethylamine (with 50%-content) | 17 | 23 |
| VIII | Imidazole | 23 | Triethylamine | 11 | 41 |
| IX | Imida zole | 9 | Dimethylamine (with 50%-content) | 17 | 23 |

Composition of Synthetic Chelating Agent

A mixture of one or more kinds of aliphatic amine were dissolved in 100 g of water, and the solution was cooled and stirred, with epichlorohydrin being added to the solution for 30 minutes. The solution was further kept stirred and heated to 95° C., and was maintained in this condition for 2 hours. Stirring was then stopped and the solution was cooled to obtain reaction products X and XI. The reaction products X and XI were obtained in the form of aqueous solution, and their concentration was about 25%.

The kinds and added amount of aliphatic amine and the added amount of epichlorohydrin are shown in Table 3.

TABLE 3

| Reaction Product No. | Aliphatic Amine Kind | Aliphatic Amine Added Amount (g) | Epichlorohydrin Added Amount (g) |
|---|---|---|---|
| X | Diethylenetriamine | 17 | 16 |
| XI | Diethylenetriamine | 15 | |
| | Monoethanolamine | 2 | 16 |

Preparation of Zn-Fe Alloy Electroplating Bath

Fifteen kinds of zincate type Zn-Fe alloy electroplating baths (Nos. 1 to 15) containing ZnO as a Zn compound, NaOH as an alkali hydroxide, $Fe_2(SO_4)_3.7H_2O$ as an Fe salt, triethanolamine as a chelating agent, brightening agents 1 and 2, and brightening auxiliaries were prepared. As reference electroplating baths, a bath (No. 1') containing the brightening agent 1, a bath (No. 2') containing the brightening agent 2, and a bath (No. 3') containing another brightening agent were prepared.

Respective compositions of the above electroplating baths are shown in Table 4.

TABLE 4

| Bath No. | ZnO (g/l) | NaOH (g/l) | $Fe_2(SO_4)_3.7H_2O$ (g/l) | Triethanolamine (g/l) | Brightening Agent 1 No. | Brightening Agent 1 Amt. (g/l) | Brightening Agent 2 No. | Brightening Agent 2 Amt. (g/l) | Brightening Agent A* (g/l) | Brightening Auxiliary Vanillin (g/l) | Brightening Auxiliary PVA (g/l) | Brightening Auxiliary Thiourea (g/l) |
|---|---|---|---|---|---|---|---|---|---|---|---|---|
| 1 | 10 | 80 | 0.5 | 0.6 | I | 3 | VIII | 3 | — | 0.05 | — | — |
| 2 | 10 | 130 | 0.5 | 21.4 | II | 3 | VII | 3 | — | 0.05 | 0.2 | 0.2 |
| 3 | 10 | 150 | 2.4 | 13.4 | III | 3 | VI | 3 | — | 0.05 | — | — |
| 4 | 10 | 100 | 2.4 | 53.4 | IV | 3 | VIII | 3 | — | 0.05 | 0.2 | 0.2 |
| 5 | 40 | 130 | 0.5 | 1.4 | V | 3 | VII | 3 | — | 0.05 | — | — |
| 6 | 40 | 100 | 0.5 | 21.4 | IV | 3 | VI | 3 | — | 0.05 | 0.2 | 0.2 |

TABLE 4-continued

| Bath No. | ZnO (g/l) | NaOH (g/l) | $Fe_2(SO_4)_3.7H_2O$ (g/l) | Triethanolamine (g/l) | Brightening Agent 1 No. | Brightening Agent 1 Amt. (g/l) | Brightening Agent 2 No. | Brightening Agent 2 Amt. (g/l) | Brightening Agent A* (g/l) | Brightening Auxiliary Vanillin (g/l) | Brightening Auxiliary PVA (g/l) | Brightening Auxiliary Thiourea (g/l) |
|---|---|---|---|---|---|---|---|---|---|---|---|---|
| 7 | 40 | 80 | 9.5 | 10.7 | II | 3 | VIII | 3 | — | 0.05 | — | — |
| 8 | 40 | 150 | 9.5 | 107 | V | 3 | VII | 3 | — | 0.05 | 0.2 | 0.2 |
| 9 | 25 | 130 | 1.9 | 42.7 | III | 3 | VI | 3 | — | 0.05 | — | — |
| 10 | 25 | 130 | 1.9 | 42.7 | III | 0.5 | VI | 0.5 | — | 0.05 | 0.2 | 0.2 |
| 11 | 25 | 130 | 1.9 | 42.7 | III | 20 | VI | 20 | — | 0.05 | — | — |
| 12 | 25 | 130 | 1.9 | 42.7 | III | 0.5 | VI | 3 | — | 0.05 | 0.2 | 0.2 |
| 13 | 25 | 130 | 1.9 | 42.7 | III | 3 | VI | 10 | — | 0.05 | — | — |
| 14 | 25 | 130 | 1.9 | 42.7 | III | 10 | VI | 3 | — | 0.05 | 0.2 | 0.2 |
| 15 | 25 | 130 | 1.9 | 42.7 | III | 3 | VI | 0.5 | — | 0.05 | — | — |
| 1' | 25 | 130 | 1.9 | 42.7 | III | 3 | — | — | — | 0.05 | 0.2 | 0.2 |
| 2' | 25 | 130 | 1.9 | 42.7 | — | — | VIII | 3 | — | 0.05 | 0.2 | 0.2 |
| 3' | 25 | 130 | 1.9 | 42.7 | — | — | — | — | 5 | 0.05 | — | — |

*Reaction product of diethylenetriamine with epichlorohydrin in a mole ratio of 1:1.

Zn-Fe Alloy Electroplating

TABLE 5

| Bath No. | Electroplated Coating Appearance 0.1 A/dm² | 0.5 A/dm² | 2 A/dm² | 5 A/dm² | 10 A/dm² | 20 A/dm² | Deposition Ratio of Fe (Weight %) 0.1 A/dm² | 0.5 A/dm² | 2 A/dm² | 5 A/dm² | 10 A/dm² | 20 A/dm² |
|---|---|---|---|---|---|---|---|---|---|---|---|---|
| 1 | A | A | A | A | A | A | 5.3 | 4.0 | 2.2 | 1.4 | 1.2 | 1.0 |
| 2 | A | A | A | A | A | A | 0.39 | 0.38 | 0.37 | 0.30 | 0.28 | 0.27 |
| 3 | A | A | A | A | A | A | 2.4 | 2.2 | 2.0 | 1.7 | 1.5 | 1.3 |
| 4 | A | A | A | A | A | A | 1.7 | 1.5 | 1.4 | 1.1 | 1.0 | 0.93 |
| 5 | A | A | A | A | A | A | 1.2 | 0.94 | 0.53 | 0.36 | 0.29 | 0.24 |
| 6 | A | A | A | A | A | A | 0.33 | 0.25 | 0.19 | 0.16 | 0.14 | 0.13 |
| 7 | A | A | A | A | A | A | 12.2 | 9.4 | 7.1 | 6.0 | 4.7 | 3.5 |
| 8 | A | A | A | A | A | A | 2.0 | 1.8 | 1.6 | 1.4 | 1.1 | 1.0 |
| 9 | A | A | A | A | A | A | 0.57 | 0.55 | 0.52 | 0.50 | 0.49 | 0.48 |
| 10 | A | A | A | A | A | A | 0.69 | 0.67 | 0.63 | 0.60 | 0.59 | 0.58 |
| 11 | A | A | A | A | A | A | 0.61 | 0.58 | 0.51 | 0.45 | 0.44 | 0.43 |
| 12 | A | A | A | A | A | A | 0.62 | 0.59 | 0.57 | 0.53 | 0.52 | 0.50 |
| 13 | A | A | A | A | A | A | 0.60 | 0.58 | 0.54 | 0.51 | 0.50 | 0.48 |
| 14 | A | A | A | A | A | A | 0.56 | 0.54 | 0.51 | 0.49 | 0.47 | 0.46 |
| 15 | A | A | A | A | A | A | 0.55 | 0.52 | 0.49 | 0.45 | 0.43 | 0.42 |
| 1' | A | A | A | A | B | B | 0.45 | 0.43 | 0.42 | 0.41 | 0.40 | 0.38 |
| 2' | C | C | A | A | A | A | 0.65 | 0.63 | 0.59 | 0.54 | 0.53 | 0.52 |
| 3' | C | C | D | D | B | B | 0.44 | 0.48 | 0.52 | 0.62 | 0.85 | 0.91 |

A: good brightness
B: coarse gray deposits
C: heavily dull deposits
D: brightness with gas burnt deposits Electroplating was carried out using the electroplating baths shown in Table 4 under the following plating conditions.

Bath temperature: 25° C.
Plating time: 10 min
Cathode material: polished iron plate (polished cupper plate for measurement of the Fe deposition ratio)
Cathode current density: 0.1, 0.5, 2, 5, 10, 20 (A/dm²)

As to the resulting electroplated coatings, the relationship between the current density and the appearance and the relationship between the current density and deposition ratio of Fe are shown in Table 5. The appearance was visually examined, and the deposition ratio was determined through atomic absorption analysis of peeled electroplated coatings.

As is apparent from Table 5, in all of the electroplating baths Nos. 1 to 15, plated coatings having excellent brightness were obtained throughout the current density range from 0.1 to 20 A/dm². Variations in the deposition ratio of Fe due to change of the current density were generally small, and especially in the baths Nos. 9 to 15, the variations in the deposition ratio was very small. As to the reference electroplating baths, plated coatings could not have good brightness or the current density range assuring good plated coatings was limited.

Preparation of Zn-Ni Alloy Electroplating Bath

Fifteen kinds of zincate type Zn-Ni alloy electroplating baths (Nos. 16 to 30) containing ZnO as a Zn compound, NaOH as an alkali hydroxide, $NiSO_4.6H_2O$ as a Ni salt, diethylenetriamine as a chelating agent, brightening agents 1 and 2, and brightening auxiliaries were prepared. As reference electroplating baths, a bath (No. 16') containing the brightening agent 1, a bath (No. 17') containing the brightening agent 2 and baths (Nos. 18'and 19') containing other brightening agents were prepared. Respective compositions of the above electroplating baths are shown in Table 6.

Further, 44 kinds of zincate type Zn-Ni alloy electroplating baths (Nos. 31 to 74) containing ZnO, NaOH, $NiSO_4.6H_2O$, chelating agent A, and brightening agents 1 and 2 were prepared. Respective compositions of the electroplating baths are shown in Tables 7, 8 and 9. Specifically, Table 7 shows baths Nos. 31 to 45 containing ZnO, NaOH, $NiSO_4.6H_2O$, chelating agent A, and brightening agents 1 and 2, and reference baths No. 31' containing the brightening agent 1, No. 32' containing the brightening agent 2, and Nos. 33' and 34' containing other brightening agents. Table 8 shows baths Nos. 46 to 60 in which basically two kinds of brightening agent 2 are used, and reference baths No. 53′ containing the brightening agent 1, No. 54′ containing the brightening agent 2, and Nos. 55′ and 56′ containing other brightening agents. Table 9 shows baths Nos. 61 to 74 which use different combinations of brightening agents 1 and 2.

TABLE 6

| Bath No. | ZnO (g/l) | NaOH (g/l) | $NiSO_4.6H_2O$ (g/l) | Diethylenetriamine (g/l) | Brightening Agent 1 No. | Brightening Agent 1 Amt. (g/l) | Brightening Agent 2 No. | Brightening Agent 2 Amt. (g/l) | Brightening Agent B* (g/l) | Brightening Agent C** (g/l) | Brightening Auxiliary Vanillin (g/l) | Brightening Auxiliary PVA (g/l) | Brightening Auxiliary Thiourea (g/l) |
|---|---|---|---|---|---|---|---|---|---|---|---|---|---|
| 16 | 4 | 80 | 0.9 | 0.7 | I | 3 | VI | 3 | — | — | 0.05 | — | — |
| 17 | 4 | 120 | 0.9 | 7.0 | III | 3 | VII | 3 | — | — | 0.05 | 0.2 | 0.2 |
| 18 | 4 | 140 | 3.6 | 2.8 | II | 3 | VIII | 3 | — | — | 0.05 | — | — |
| 19 | 4 | 100 | 3.6 | 28.1 | IV | 3 | VI | 3 | — | — | 0.05 | 0.2 | 0.2 |
| 20 | 25 | 120 | 0.9 | 0.7 | V | 3 | VII | 3 | — | — | 0.05 | — | — |
| 21 | 25 | 100 | 0.9 | 7.0 | II | 3 | VIII | 3 | — | — | 0.05 | 0.2 | 0.2 |
| 22 | 25 | 80 | 22.5 | 17.5 | IV | 3 | VI | 3 | — | — | 0.05 | — | — |
| 23 | 25 | 140 | 22.5 | 87.7 | V | 3 | VII | 3 | — | — | 0.05 | 0.2 | 0.2 |
| 24 | 10 | 120 | 3.6 | 5.6 | III | 3 | VIII | 3 | — | — | 0.05 | — | — |
| 25 | 10 | 120 | 3.6 | 5.6 | III | 0.5 | VIII | 0.5 | — | — | 0.05 | 0.2 | 0.2 |
| 26 | 10 | 120 | 3.6 | 5.6 | III | 20 | VIII | 20 | — | — | 0.05 | — | — |
| 27 | 10 | 120 | 3.6 | 5.6 | III | 0.5 | VIII | 3 | — | — | 0.05 | 0.2 | 0.2 |
| 28 | 10 | 120 | 3.6 | 5.6 | III | 3 | VIII | 10 | — | — | 0.05 | — | — |
| 29 | 10 | 120 | 3.6 | 5.6 | III | 10 | VIII | 3 | — | — | 0.05 | 0.2 | 0.2 |
| 30 | 10 | 120 | 3.6 | 5.6 | III | 3 | VIII | 0.5 | — | — | 0.05 | — | — |
| 16′ | 10 | 120 | 3.6 | 5.6 | III | 3 | — | — | — | — | 0.05 | 0.2 | 0.2 |
| 17′ | 10 | 120 | 3.6 | 5.6 | — | — | VI | 3 | — | — | 0.05 | 0.2 | 0.2 |
| 18′ | 10 | 120 | 3.6 | 5.6 | — | — | — | — | 1.5 | — | 0.05 | 0.2 | 0.2 |
| 19′ | 10 | 120 | 3.6 | 5.6 | — | — | — | — | — | 5 | 0.05 | — | — |

*Polyethyleneimine (molecular weight of 1400)
**Reaction product of dimethylamine with epichlorohydrin in a mole ratio of 1:1

TABLE 7

| Bath No. | ZnO (g/l) | NaOH (g/l) | $NiSO_4.6H_2O$ (g/l) | Synthetic Chelating Agent A No. | Synthetic Chelating Agent A (g/l) | Brightening Agent 1 No. | Brightening Agent 1 Amt. (g/l) | Brightening Agent 2 No. | Brightening Agent 2 Amt. (g/l) | Brightening Agent B* (g/l) | Brightening Agent C** (g/l) | Brightening Auxiliary Vanillin (g/l) | Brightening Auxiliary PVA (g/l) | Brightening Auxiliary Thiourea (g/l) |
|---|---|---|---|---|---|---|---|---|---|---|---|---|---|---|
| 31 | 4 | 80 | 1.4 | X | 8.3 | I | 3 | VI | 3 | — | — | 0.05 | — | — |
| 32 | 4 | 120 | 1.4 | X | 82.9 | III | 3 | VII | 3 | — | — | 0.05 | 0.2 | 0.2 |
| 33 | 4 | 140 | 5.4 | X | 32.0 | II | 3 | VIII | 3 | — | — | 0.05 | — | — |
| 34 | 4 | 100 | 5.4 | X | 320.0 | IV | 3 | VI | 3 | — | — | 0.05 | 0.2 | 0.2 |
| 35 | 25 | 120 | 1.4 | X | 8.3 | V | 3 | VII | 3 | — | — | 0.05 | — | — |
| 36 | 25 | 100 | 1.4 | X | 82.9 | II | 3 | VIII | 3 | — | — | 0.05 | 0.2 | 0.2 |
| 37 | 25 | 80 | 33.8 | X | 200.3 | IV | 3 | VI | 3 | — | — | 0.05 | — | — |
| 38 | 25 | 140 | 33.8 | X | 801.2 | V | 3 | VII | 3 | — | — | 0.05 | 0.2 | 0.2 |
| 39 | 10 | 120 | 5.4 | X | 64.0 | III | 3 | VIII | 3 | — | — | 0.05 | — | — |
| 40 | 10 | 120 | 5.4 | X | 64.0 | III | 0.5 | VIII | 0.5 | — | — | 0.05 | 0.2 | 0.2 |
| 41 | 10 | 120 | 5.4 | X | 64.0 | III | 20 | VIII | 20 | — | — | 0.05 | — | — |
| 42 | 10 | 120 | 5.4 | X | 64.0 | III | 0.5 | VIII | 3 | — | — | 0.05 | 0.2 | 0.2 |
| 43 | 10 | 120 | 5.4 | X | 64.0 | III | 3 | VIII | 10 | — | — | 0.05 | — | — |
| 44 | 10 | 120 | 5.4 | X | 64.0 | III | 10 | VIII | 3 | — | — | 0.05 | 0.2 | 0.2 |
| 45 | 10 | 120 | 5.4 | X | 64.0 | III | 3 | VIII | 0.5 | — | — | 0.05 | — | — |
| 31′ | 10 | 120 | 5.4 | X | 64.0 | III | 3 | — | — | — | — | 0.05 | 0.2 | 0.2 |
| 32′ | 10 | 120 | 5.4 | X | 64.0 | — | — | VI | 3 | — | — | 0.05 | 0.2 | 0.2 |
| 33′ | 10 | 120 | 5.4 | X | 64.0 | — | — | — | — | 1.5 | — | 0.05 | 0.2 | 0.2 |
| 34′ | 10 | 120 | 5.4 | X | 64.0 | — | — | — | — | — | 5 | 0.05 | — | — |

*Polyethyleneimine (molecular weight of 1400)
**Reaction product of dimethylamine with epichlorohydrin in a mole ratio of 1:1

TABLE 8

| Bath No. | ZnO (g/l) | NaOH (g/l) | $NiSO_4.6H_2O$ (g/l) | Synthetic Chelating Agent A No. | Synthetic Chelating Agent A (g/l) | Brightening Agent 1 No. | Brightening Agent 1 Amt. (g/l) | Brightening Agent 2 No. | Brightening Agent 2 Amt. (g/l) | Brightening Agent B* (g/l) | Brightening Agent C** (g/l) | Brightening Auxiliary Vanillin (g/l) | Brightening Auxiliary PVA (g/l) | Brightening Auxiliary Thiourea (g/l) |
|---|---|---|---|---|---|---|---|---|---|---|---|---|---|---|
| 46 | 10 | 120 | 5.4 | X | 64.0 | III | 1.5 | VI/IX | 4.5/3.0 | — | — | 0.05 | — | — |
| 47 | 10 | 120 | 5.4 | X | 64.0 | III | 0.5 | VI/IX | 1.0/0.5 | — | — | 0.05 | 0.2 | 0.2 |
| 48 | 10 | 120 | 5.4 | X | 64.0 | III | 20 | VI/IX | 10/10 | — | — | 0.05 | — | — |
| 49 | 10 | 120 | 5.4 | X | 64.0 | III | 0.5 | VI/IX | 4.5/3.0 | — | — | 0.05 | 0.2 | 0.2 |
| 50 | 10 | 120 | 5.4 | X | 64.0 | III | 1.5 | VI/IX | 10/10 | — | — | 0.05 | — | — |
| 51 | 10 | 120 | 5.4 | X | 64.0 | III | 10.0 | VI/IX | 4.5/3.0 | — | — | 0.05 | 0.2 | 0.2 |
| 52 | 10 | 120 | 5.4 | X | 64.0 | III | 1.5 | VI/IX | 1.0/0.5 | — | — | 0.05 | — | — |
| 53 | 4 | 80 | 1.6 | XI | 9.7 | I | 3 | VI | 3 | — | — | 0.05 | — | — |
| 54 | 4 | 120 | 1.6 | XI | 64.8 | III | 3 | VII | 3 | — | — | 0.05 | 0.2 | 0.2 |
| 55 | 4 | 140 | 6.3 | XI | 38.3 | II | 3 | VIII | 3 | — | — | 0.05 | — | — |
| 56 | 4 | 100 | 6.3 | XI | 255.0 | IV | 3 | VI | 3 | — | — | 0.05 | 0.2 | 0.2 |
| 57 | 25 | 120 | 1.6 | XI | 9.7 | V | 3 | VII | 3 | — | — | 0.05 | — | — |
| 58 | 25 | 100 | 1.6 | XI | 64.8 | II | 3 | VIII | 3 | — | — | 0.05 | 0.2 | 0.2 |
| 59 | 25 | 80 | 39.4 | XI | 239.2 | IV | 3 | VI | 3 | — | — | 0.05 | — | — |
| 60 | 25 | 140 | 39.4 | XI | 797.4 | V | 3 | VII | 3 | — | — | 0.05 | 0.2 | 0.2 |

TABLE 8-continued

| Bath No. | ZnO (g/l) | NaOH (g/l) | $NiSO_4.6H_2O$ (g/l) | Synthetic Chelating Agent A No. | Synthetic Chelating Agent A (g/l) | Brightening Agent 1 No. | Brightening Agent 1 Amt. (g/l) | Brightening Agent 2 No. | Brightening Agent 2 Amt. (g/l) | Bright-ening Agent B* (g/l) | Brightening Agent C** (g/l) | Brightening Auxiliary Vanillin (g/l) | Brightening Auxiliary PVA (g/l) | Brightening Auxiliary Thiourea (g/l) |
|---|---|---|---|---|---|---|---|---|---|---|---|---|---|---|
| 53' | 10 | 120 | 6.3 | XI | 76.5 | III | 3 | — | — | — | — | 0.05 | 0.2 | 0.2 |
| 54' | 10 | 120 | 6.3 | XI | 76.5 | — | — | VI | 3 | — | — | 0.05 | 0.2 | 0.2 |
| 55' | 10 | 120 | 6.3 | XI | 76.5 | — | — | — | — | 1.5 | — | 0.05 | 0.2 | 0.2 |
| 56' | 10 | 120 | 6.3 | XI | 76.5 | — | — | — | — | — | 5 | 0.05 | — | — |

*Polyethyleneimine (molecular weight of 1400)
**Reaction product of dimethylamine with epichlorohydrin in a mole ratio of 1:1

TABLE 9

| Bath No. | ZnO (g/l) | NaOH (g/l) | $NiSO_4.6H_2O$ (g/l) | Synthetic Chelating Agent A No. | Synthetic Chelating Agent A (g/l) | Brightening Agent 1 No. | Brightening Agent 1 Amt. (g/l) | Brightening Agent 2 No. | Brightening Agent 2 Amt. (g/l) | Bright-ening Agent B* (g/l) | Brightening Agent C** (g/l) | Brightening Auxiliary Vanillin (g/l) | Brightening Auxiliary PVA (g/l) | Brightening Auxiliary Thiourea (g/l) |
|---|---|---|---|---|---|---|---|---|---|---|---|---|---|---|
| 61 | 10 | 120 | 6.3 | XI | 76.5 | III | 3 | VIII | 3 | — | — | 0.05 | — | — |
| 62 | 10 | 120 | 6.3 | XI | 76.5 | III | 0.5 | VIII | 0.5 | — | — | 0.05 | 0.2 | 0.2 |
| 63 | 10 | 120 | 6.3 | XI | 76.5 | III | 20 | VIII | 20 | — | — | 0.05 | — | — |
| 64 | 10 | 120 | 6.3 | XI | 76.5 | III | 0.5 | VIII | 3 | — | — | 0.05 | 0.2 | 0.2 |
| 65 | 10 | 120 | 6.3 | XI | 76.5 | III | 3 | VIII | 10 | — | — | 0.05 | — | — |
| 66 | 10 | 120 | 6.3 | XI | 76.5 | III | 10 | VIII | 3 | — | — | 0.05 | 0.2 | 0.2 |
| 67 | 10 | 120 | 6.3 | XI | 76.5 | III | 3 | VIII | 0.5 | — | — | 0.05 | — | — |
| 68 | 10 | 120 | 6.3 | XI | 76.5 | III | 1.5 | VI/IX | 4.5/3.0 | — | — | 0.05 | — | — |
| 69 | 10 | 120 | 6.3 | XI | 76.5 | III | 0.5 | VI/IX | 1.0/0.5 | — | — | 0.05 | 0.2 | 0.2 |
| 70 | 10 | 120 | 6.3 | XI | 76.5 | III | 20 | VI/IX | 10/10 | — | — | 0.05 | — | — |
| 71 | 10 | 120 | 6.3 | XI | 76.5 | III | 0.5 | VI/IX | 4.5/3.0 | — | — | 0.05 | 0.2 | 0.2 |
| 72 | 10 | 120 | 6.3 | XI | 76.5 | III | 1.5 | VI/IX | 10/10 | — | — | 0.05 | — | — |
| 73 | 10 | 120 | 6.3 | XI | 76.5 | III | 10 | VI/IX | 4.5/3.0 | — | — | 0.05 | 0.2 | 0.2 |
| 74 | 10 | 120 | 6.3 | XI | 76.5 | III | 1.5 | VI/IX | 1.0/0.5 | — | — | 0.05 | — | — |

*Polyethyleneimine (molecular weight of 1400)
**Reaction product of dimethylamine with epichlorohydrin in a mole ratio of 1:1

Zn-Ni Alloy Electroplating

Electroplating was carried out using the electroplating baths shown in Tables 6, 7, 8 and 9 under the following plating conditions.

Bath temperature: 25° C.
Plating time: 10 min
Cathode material: polished iron plate
Cathode current density: 0.1, 0.5, 2, 5, 10, 20 ($A/dm^2$)

As to the resulting electroplated coatings, the relationship between the current density and the appearance and the relationship between the current density and the deposition ratio of Ni are shown in Tables 10, 11, 12 and 13. The appearance was visually examined, and the deposition ratio was determined through atomic absorption analysis of peeled electroplated coatings.

TABLE 10

| Bath No. | Electroplated Coating Appearance 0.1 $A/dm^2$ | 0.5 $A/dm^2$ | 2 $A/dm^2$ | 5 $A/dm^2$ | 10 $A/dm^2$ | 20 $A/dm^2$ | Deposition Ratio of Ni (Weight %) 0.1 $A/dm^2$ | 0.5 $A/dm^2$ | 2 $A/dm^2$ | 5 $A/dm^2$ | 10 $A/dm^2$ | 20 $A/dm^2$ |
|---|---|---|---|---|---|---|---|---|---|---|---|---|
| 16 | A | A | A | A | A | A | 5.6 | 5.7 | 6.0 | 6.2 | 6.4 | 6.5 |
| 17 | A | A | A | A | A | A | 3.9 | 4.0 | 4.2 | 4.3 | 4.4 | 4.5 |
| 18 | A | A | A | A | A | A | 10.4 | 10.6 | 10.9 | 11.2 | 11.4 | 11.5 |
| 19 | A | A | A | A | A | A | 8.2 | 8.4 | 8.7 | 8.9 | 9.0 | 9.1 |
| 20 | A | A | A | A | A | A | 1.5 | 1.6 | 1.8 | 2.0 | 2.1 | 2.2 |
| 21 | A | A | A | A | A | A | 0.9 | 1.0 | 1.2 | 1.4 | 1.5 | 1.5 |
| 22 | A | A | A | A | A | A | 9.9 | 10.1 | 10.4 | 10.6 | 10.8 | 10.9 |
| 23 | A | A | A | A | A | A | 9.0 | 9.1 | 9.4 | 9.7 | 9.8 | 9.9 |
| 24 | A | A | A | A | A | A | 7.7 | 7.8 | 8.0 | 8.3 | 8.4 | 8.5 |
| 25 | A | A | A | A | A | A | 7.8 | 8.0 | 8.2 | 8.4 | 8.6 | 8.7 |
| 26 | A | A | A | A | A | A | 7.8 | 7.9 | 8.1 | 8.3 | 8.5 | 8.5 |
| 27 | A | A | A | A | A | A | 7.8 | 8.0 | 8.2 | 8.4 | 8.5 | 8.6 |
| 28 | A | A | A | A | A | A | 7.9 | 8.0 | 8.2 | 8.4 | 8.6 | 8.6 |
| 29 | A | A | A | A | A | A | 7.4 | 7.5 | 7.8 | 8.0 | 8.2 | 8.3 |
| 30 | A | A | A | A | A | A | 7.2 | 7.4 | 7.7 | 7.8 | 8.0 | 8.2 |
| 16' | A | A | A | A | B | B | 6.8 | 7.0 | 7.4 | 7.6 | 7.8 | 7.9 |
| 17' | C | C | A | A | A | A | 8.0 | 8.2 | 8.6 | 8.8 | 9.0 | 9.1 |
| 18' | A | A | C | C | B | B | 5.9 | 6.1 | 6.6 | 7.2 | 7.9 | 8.4 |
| 19' | E | E | E | B | B | B | 6.3 | 6.8 | 7.0 | 8.1 | 8.7 | 9.2 |

A: good brightness
B: coarse gray deposits
C: heavily dull deposits
E: dull brightness

TABLE 11

| Bath No. | Electroplated Coating Appearance 0.1 A/dm² | 0.5 A/dm² | 2 A/dm² | 5 A/dm² | 10 A/dm² | 20 A/dm² | Deposition Ratio of Ni (Weight %) 0.1 A/dm² | 0.5 A/dm² | 2 A/dm² | 5 A/dm² | 10 A/dm² | 20 A/dm² |
|---|---|---|---|---|---|---|---|---|---|---|---|---|
| 31 | A | A | A | A | A | A | 6.1 | 6.2 | 6.5 | 6.7 | 6.9 | 7.0 |
| 32 | A | A | A | A | A | A | 3.7 | 3.8 | 4.0 | 4.1 | 4.2 | 4.3 |
| 33 | A | A | A | A | A | A | 11.9 | 12.1 | 12.4 | 12.7 | 12.9 | 13.0 |
| 34 | A | A | A | A | A | A | 8.3 | 8.5 | 8.8 | 9.0 | 9.1 | 9.2 |
| 35 | A | A | A | A | A | A | 1.7 | 1.8 | 2.0 | 2.2 | 2.3 | 2.4 |
| 36 | A | A | A | A | A | A | 0.8 | 0.9 | 1.1 | 1.3 | 1.4 | 1.4 |
| 37 | A | A | A | A | A | A | 9.8 | 10.0 | 10.3 | 10.5 | 10.7 | 10.8 |
| 38 | A | A | A | A | A | A | 8.9 | 9.0 | 9.3 | 9.7 | 9.8 | 9.9 |
| 39 | A | A | A | A | A | A | 7.2 | 7.3 | 7.5 | 7.8 | 7.9 | 8.0 |
| 40 | A | A | A | A | A | A | 7.3 | 7.5 | 7.7 | 7.8 | 8.0 | 8.2 |
| 41 | A | A | A | A | A | A | 7.3 | 7.4 | 7.6 | 7.7 | 7.9 | 8.1 |
| 42 | A | A | A | A | A | A | 7.3 | 7.5 | 7.7 | 7.8 | 7.9 | 8.2 |
| 43 | A | A | A | A | A | A | 7.4 | 7.5 | 7.7 | 7.8 | 8.0 | 8.2 |
| 44 | A | A | A | A | A | A | 6.9 | 7.0 | 7.2 | 7.4 | 7.6 | 7.9 |
| 45 | A | A | A | A | A | A | 6.7 | 6.9 | 7.1 | 7.2 | 7.4 | 7.8 |
| 31' | A | A | A | A | B | B | 6.9 | 7.0 | 7.3 | 7.5 | 7.7 | 7.8 |
| 32' | C | C | A | A | A | A | 8.0 | 8.2 | 8.5 | 8.7 | 9.1 | 9.1 |
| 33' | A | A | C | C | B | B | 5.9 | 6.1 | 6.6 | 7.1 | 8.0 | 8.5 |
| 34' | E | E | E | B | B | B | 6.1 | 6.7 | 7.1 | 8.1 | 8.8 | 9.3 |

A: good brightness
B: coarse gray deposits
C: heavily dull deposits
E: dull brightness

TABLE 12

| Bath No. | Electroplated Coating Appearance 0.1 A/dm² | 0.5 A/dm² | 2 A/dm² | 5 A/dm² | 10 A/dm² | 20 A/dm² | Deposition Ratio of Ni (Weight %) 0.1 A/dm² | 0.5 A/dm² | 2 A/dm² | 5 A/dm² | 10 A/dm² | 20 A/dm² |
|---|---|---|---|---|---|---|---|---|---|---|---|---|
| 46 | A | A | A | A | A | A | 7.3 | 7.4 | 7.6 | 7.9 | 8.0 | 8.1 |
| 47 | A | A | A | A | A | A | 7.4 | 7.6 | 7.8 | 7.9 | 8.1 | 8.3 |
| 48 | A | A | A | A | A | A | 7.4 | 7.5 | 7.7 | 7.8 | 8.0 | 8.2 |
| 49 | A | A | A | A | A | A | 7.4 | 7.7 | 7.8 | 7.9 | 8.0 | 8.3 |
| 50 | A | A | A | A | A | A | 7.5 | 7.7 | 7.8 | 7.9 | 8.1 | 8.3 |
| 51 | A | A | A | A | A | A | 7.0 | 7.2 | 7.3 | 7.5 | 7.7 | 8.0 |
| 52 | A | A | A | A | A | A | 6.8 | 7.1 | 7.2 | 7.3 | 7.5 | 7.9 |
| 53 | A | A | A | A | A | A | 5.7 | 6.0 | 6.2 | 6.4 | 6.5 | 6.6 |
| 54 | A | A | A | A | A | A | 3.9 | 4.0 | 4.3 | 4.4 | 4.6 | 4.7 |
| 55 | A | A | A | A | A | A | 10.6 | 10.8 | 11.2 | 11.5 | 11.7 | 11.8 |
| 56 | A | A | A | A | A | A | 8.2 | 8.4 | 8.9 | 9.1 | 9.2 | 9.2 |
| 57 | A | A | A | A | A | A | 1.6 | 1.7 | 1.9 | 2.1 | 2.2 | 2.2 |
| 58 | A | A | A | A | A | A | 0.9 | 1.1 | 1.2 | 1.4 | 1.6 | 1.6 |
| 59 | A | A | A | A | A | A | 10.1 | 10.3 | 10.7 | 10.9 | 11.2 | 11.3 |
| 60 | A | A | A | A | A | A | 8.9 | 9.0 | 9.3 | 9.7 | 9.9 | 10.0 |
| 53' | A | A | A | A | B | B | 6.8 | 7.0 | 7.3 | 7.5 | 7.8 | 7.9 |
| 54' | C | C | A | A | A | A | 7.9 | 8.1 | 8.5 | 8.7 | 9.0 | 9.0 |
| 55' | A | A | C | C | B | B | 6.0 | 6.2 | 6.8 | 7.3 | 8.0 | 8.5 |
| 56' | E | E | E | B | B | B | 6.2 | 6.7 | 7.0 | 8.0 | 8.6 | 9.1 |

A: good brightness
B: coarse gray deposits
C: heavily dull deposits
E: dull brightness

TABLE 13

| Bath No. | Electroplated Coating Appearance 0.1 A/dm² | 0.5 A/dm² | 2 A/dm² | 5 A/dm² | 10 A/dm² | 20 A/dm² | Deposition Ratio of Ni (Weight %) 0.1 A/dm² | 0.5 A/dm² | 2 A/dm² | 5 A/dm² | 10 A/dm² | 20 A/dm² |
|---|---|---|---|---|---|---|---|---|---|---|---|---|
| 61 | A | A | A | A | A | A | 7.5 | 7.6 | 7.8 | 8.1 | 8.2 | 8.3 |
| 62 | A | A | A | A | A | A | 7.7 | 7.9 | 8.0 | 8.2 | 8.4 | 8.5 |
| 63 | A | A | A | A | A | A | 7.7 | 7.8 | 8.0 | 8.1 | 8.3 | 8.4 |
| 64 | A | A | A | A | A | A | 7.8 | 8.0 | 8.1 | 8.2 | 8.3 | 8.5 |
| 65 | A | A | A | A | A | A | 8.0 | 8.1 | 8.2 | 8.4 | 8.5 | 8.7 |
| 66 | A | A | A | A | A | A | 7.1 | 7.3 | 7.7 | 7.9 | 8.1 | 8.3 |
| 67 | A | A | A | A | A | A | 7.0 | 7.2 | 7.6 | 7.7 | 7.9 | 8.0 |
| 68 | A | A | A | A | A | A | 7.6 | 7.7 | 7.9 | 8.2 | 8.3 | 8.3 |
| 69 | A | A | A | A | A | A | 7.7 | 7.8 | 8.1 | 8.3 | 8.5 | 8.6 |
| 70 | A | A | A | A | A | A | 7.7 | 7.9 | 8.0 | 8.2 | 8.4 | 8.6 |
| 71 | A | A | A | A | A | A | 7.7 | 7.9 | 8.1 | 8.2 | 8.5 | 8.7 |
| 72 | A | A | A | A | A | A | 8.0 | 8.1 | 8.3 | 8.4 | 8.6 | 8.8 |
| 73 | A | A | A | A | A | A | 7.5 | 7.6 | 7.9 | 8.1 | 8.3 | 8.4 |
| 74 | A | A | A | A | A | A | 7.3 | 7.5 | 7.8 | 7.9 | 8.1 | 8.3 |

A: good brightness

As is apparent from Table 10, in all of the electroplating baths Nos. 16 to 30, plated coatings having excellent brightness were obtained throughout the current density range from 0.1 to 20 A/dm$^2$. Variations in the deposition ratio of Ni due to change of the current density were very small in all of the baths Nos. 16 to 30. Also, as is apparent from Table 11, in all of the electroplating baths Nos. 31 to 45, plated coatings having excellent brightness and uniform Ni deposition ratio were obtained. In the baths Nos. 46 to 60 shown in Table 12 and Nos. 61 to 74 shown in Table 13, the same results as the baths Nos. 31 to 45 were obtained. Thus, in the baths Nos. 31 to 74, variations of the Ni deposition ratio were very small, i.e., ±0.5%. As to the reference electroplating baths, plated coatings could not have good brightness or the current density range assuring good plated coatings was limited.

While the invention has been described and illustrated herein by references to various specific materials, procedures and examples, it is understood that the invention is not restricted to the particular materials, combinations of materials, and procedures selected for that purpose. Numerous variations of such details can be employed, as will be appreciated by those skilled in the art.

What is claimed is:

1. A zincate type zinc alloy electroplating bath comprising a Zn compound, an alkali hydroxide, a salt of Fe(II, III) or Ni(II), a chelating agent for dissolving said salt of Fe(II, III) or Ni(II), and brightening agents containing alkylated polyalkylene polyamine in which some of the basic nitrogen atoms of the polyalkylene polyamine are alkylated by alkyl groups of $C_1$ to $C_3$, and at least one compound selected from the group consisting of reaction products of imidazole or its derivative with epihalohydrin and reaction products of imidazole or its derivative with epihalohydrin in the presence of aliphatic amine.

2. The zincate type zinc alloy electroplating bath of claim 1 wherein said reaction product of said brightening agent is formed from a reaction of imidazole with epichlorohydrin.

3. The zincate type zinc alloy electroplating bath of claim 1 wherein said reaction product of said brightening agent is formed from a reaction of 2-methylimidazole with epichlorohydrin in the presence of dimethylamine.

4. The zincate type zinc alloy electroplating bath of claim 1 wherein said reaction product of said brightening agent is formed from a reaction of imidazole with epichlorohydrin in the presence of triethylamine.

5. The zincate type zinc alloy electroplating bath of claim 1 wherein said reaction product of said brightening agent is formed from a reaction of imidazole with epichlorohydrin in the presence of dimethylamine.

6. The zincate type zinc alloy electroplating bath of claim 1 wherein said chelating agent for dissolving said salt of Fe (II, III) is triethanolamine, and wherein said chelating agent for dissolving said salt of Ni(II) is diethylenetriamine or a reaction product of diethylenetriamine with epichlorohydrin or a reaction product of a mixture of diethylenetriamine and monoethanolamine with epichlorohydrin.

7. The zincate type zinc alloy electroplating bath of claim 1 further comprising at least one auxiliary brightening agent.

8. The zincate type zinc alloy electroplating bath of claim 7 wherein said auxiliary brightening agent is vanillin.

9. The zincate type zinc alloy electroplating bath of claim 7 wherein said auxiliary brightening agent is a mixture of vanillin, polyvinyl alcohol and thiourea.

10. The zincate type zinc alloy electroplating bath of claim 1 wherein said alkylated polyalkylene polyamine and said reaction product of said brightening agent are added in the amount of from 0.5 to 10 grams per liter of the bath, respectively.

11. The zincate type zinc alloy electroplating bath of claim 10 wherein said salt of Fe(II, III) is $Fe_2(SO_4)_3.7H_2O$, and wherein said $Fe_2(SO_4)_3.7H_2O$ is added in the amount of from 0.5 to 9.5 grams per liter of the bath.

12. The zincate type zinc alloy electroplating bath of claim 10 wherein said salt of Ni(II) is $NiSO_4.6H_2O$, and wherein said $NiSO_4.6H_2O$ is added in the amount of from 0.9 to 39.4 grams per liter of the bath.

13. A method of electroplating zinc alloy wherein the zinc alloy electroplating bath of claim 1 is used.

14. The method of claim 13 wherein the cathode current density is applied in the range of from 0.1 to 20 ampere per square decimeter.

15. The zincate type zinc alloy electroplating bath of claim 1, wherein the concentration of said Zn compound is 4 to 40 g/l calculated as ZnO, the concentration of said alkali hydroxide is 30 to 200 g/l calculated as NaOH, the concentration of said Fe(II, III) or Ni(II) is 0.02 to 10 g/l, and the content of said chelating agent is 0.5 to 300 g/l.

* * * * *